United States Patent [19]

Fischer et al.

[11] Patent Number: 4,550,765

[45] Date of Patent: Nov. 5, 1985

[54] APPARATUS FOR COMPACTING GRANULAR MOLDING MATERIALS

[75] Inventors: Kurt Fischer, Schaffhausen; Franz Muller, Neuhausen, both of Switzerland

[73] Assignee: Georg Fischer Aktiengesellschaft, Schaffhausen, Switzerland

[21] Appl. No.: 551,257

[22] Filed: Nov. 14, 1983

[30] Foreign Application Priority Data

Nov. 15, 1982 [CH] Switzerland ..... 6634/82

[51] Int. Cl.[4] ..... B22C 15/00

[52] U.S. Cl. ..... 164/194; 141/71; 141/73; 164/192

[58] Field of Search ..... 164/384, 385, 374, 392, 164/169; 277/152, 205, 12, 32; 141/12, 71, 73; 49/475

[56] References Cited

U.S. PATENT DOCUMENTS 3,266,102 8/1966 Peterson ..... 164/284 X
4,174,846 11/1979 Scott ..... 277/205
4,230,172 10/1980 Vzaki ..... 164/195 X

FOREIGN PATENT DOCUMENTS 2477662 9/1981 France ..... 277/152
132530 10/1978 German Democratic Rep. ..... 277/152

*Primary Examiner*—Nicholas P. Godici
*Assistant Examiner*—G. M. Reid
*Attorney, Agent, or Firm*—Roylance, Abrams, Berdo & Goodman

[57] ABSTRACT

An apparatus for compacting granular molding material, particularly foundry molding material, includes a filling unit, a compression unit and a molding unit. A sealing surface on the molding unit is engaged by depending sealing strips on the compression unit to provide a tight seal. The opposed sealing strips extending parallel to molding unit movement have force-transmitting sealing elements, while the other pair of opposed sealing strips extending perpendicular to the molding unit movement repel molding material from the sealing surface.

18 Claims, 5 Drawing Figures

APPARATUS FOR COMPACTING GRANULAR MOLDING MATERIALS

FIELD OF THE INVENTION

The present invention relates to an apparatus for compacting granular molding materials, particularly foundry molding materials, wherein a molding unit is filled with molding material and is then coupled to a compression unit in a sealed manner for compacting the molding material over a pattern in the molding unit.

BACKGROUND OF THE INVENTION

Conventional apparatus for producing sand molds for foundry purposes have a composite mold unit comprising a frame, molding box and pattern device. The molding unit is filled with molding material from a filling unit and is then moved beneath a compression unit. The compression unit and molding unit tightly contact one another such that the molding material in the molding unit can be subsequently compacted. When the molding material is introduced into the molding unit in conventional apparatus, it often exceeds the top edge of its frame requiring the molding material to be flattened in preparation for the compacting process. When the molding material is flattened or leveled, some of the molding material will unavoidably fall upon the top edge of the molding frame providing its sealing surface. However, the sealing surface must be adequately prepared or cleaned to permit the molding unit to be sealed to the compression unit. The preparation of the sealing surface is usually accomplished by brushing or blowing the molding material off the sealing surface.

Within the overall operation of compacting systems, the required cleaning process requires a relatively long time. Thus, the conventional cleaning process disadvantageously affects the predetermined cycle duration for the molding material compacting system.

SUMMARY OF THE INVENTION

An object of the present invention is to provide an apparatus for compacting granular molding material, particularly foundry molding material, which avoids the above disadvantages of conventional apparatus and provides a tight and force-transmitting connection between the molding unit and the compression unit without adversely affecting the time required for cycling the apparatus.

The foregoing object is obtained by an apparatus for compacting granular molding material, particularly foundry molding material, comprising a molding unit moveable in a first direction, filling means for supplying molding material to the molding unit and a compression unit for compacting the molding material in the molding unit. The compression unit has a coupling at its outlet for forming a closed system with the molding unit. The coupling includes a sealing surface and first and second pairs of opposed sealing strips engaging the sealing surface. The first pair of sealing strips extends substantially parallel to the direction of molding unit movement and has force-transmitting sealing elements. The second pair of sealing strips extends substantially perpendicular to the direction of molding unit movement and has sealing elements which repel molding material.

By forming the apparatus in this manner, the molding material on the sealing surface will be adequately removed therefrom without a separate processing step for such cleaning operation.

Other objects, advantages and salient features of the present invention will become apparent from the following detailed description, which, taken in connection with the annexed drawings, disclosed preferred embodiments of the present invention.

BRIEF DESCRIPTION OF THE DRAWINGS

Referring to the drawings which form a part of this disclosure.

DETAILED DESCRIPTION OF PREFERRED EMBODIMENTS OF THE INVENTION

Figure 1:
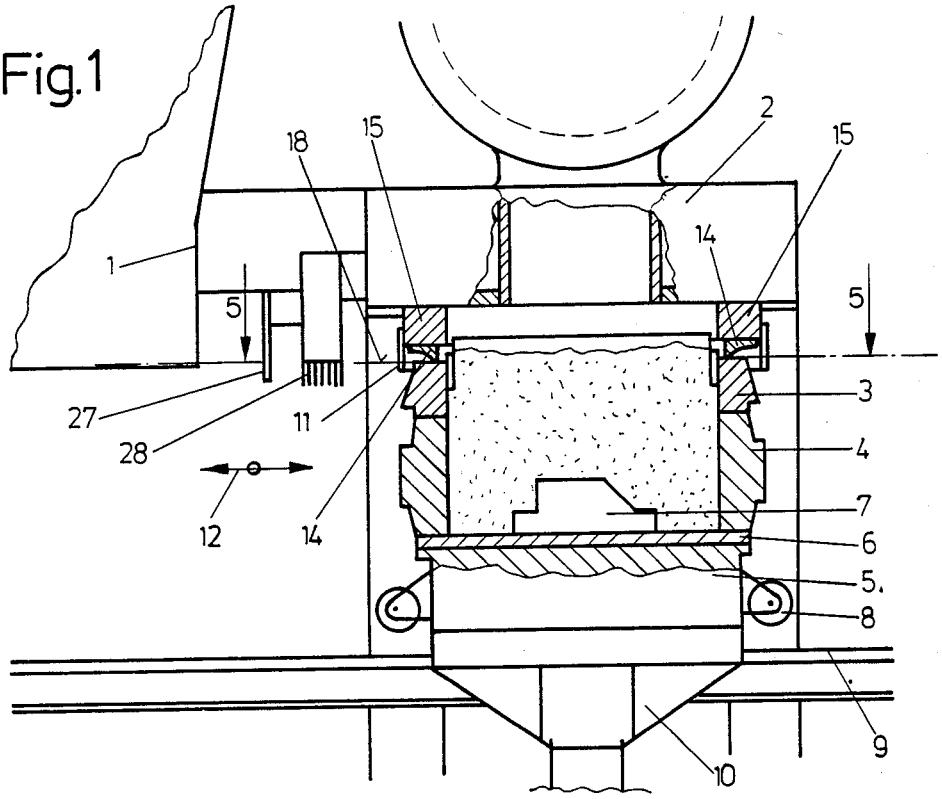
FIG. 1 is a front elevational view in section of a apparatus for compacting granular molding materials according to the present invention.
Figure 2:
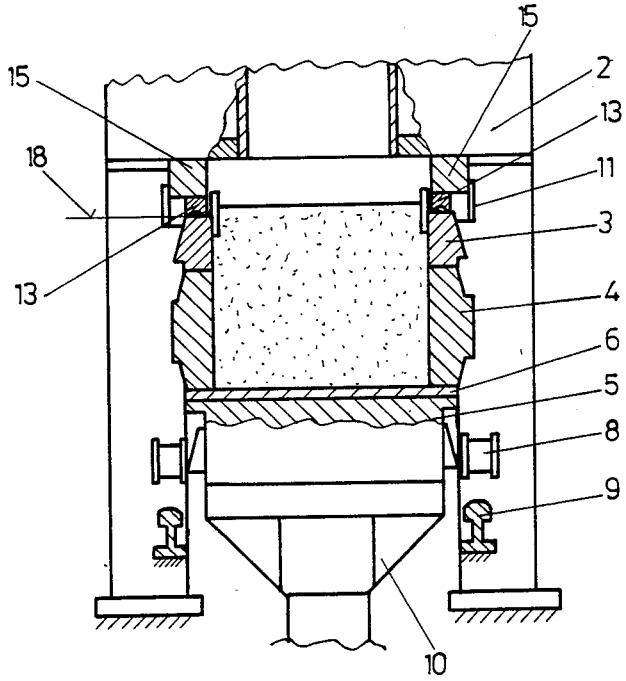
FIG. 2 is side elevational view in section viewed in a direction perpendicular to the direction of molding unit movement of the apparatus of FIG. 1.
Figure 3:
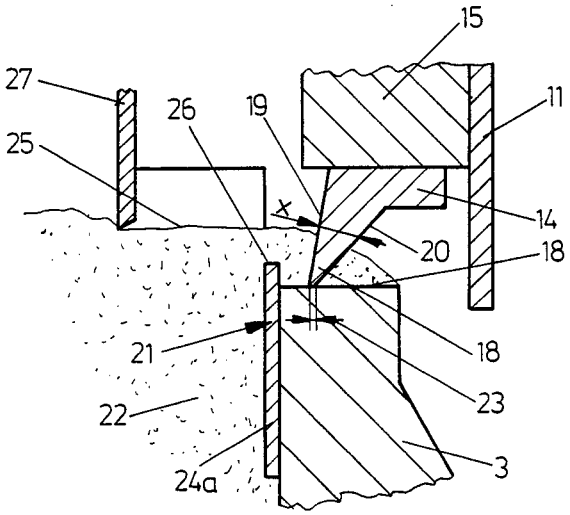
FIG. 3 is a partial, enlarged elevational view in section of the sealing strips extending transverse to the direction of molding unit movement.
Figure 4:
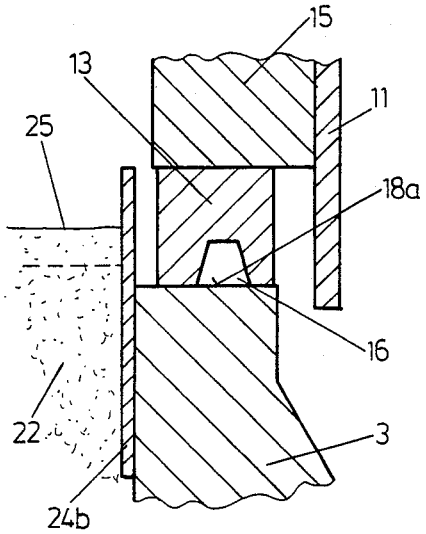
FIG. 4 is an enlarged, partial elevational view in section of the sealing strips extending parallel to the direction of molding unit movement.
Figure 5:
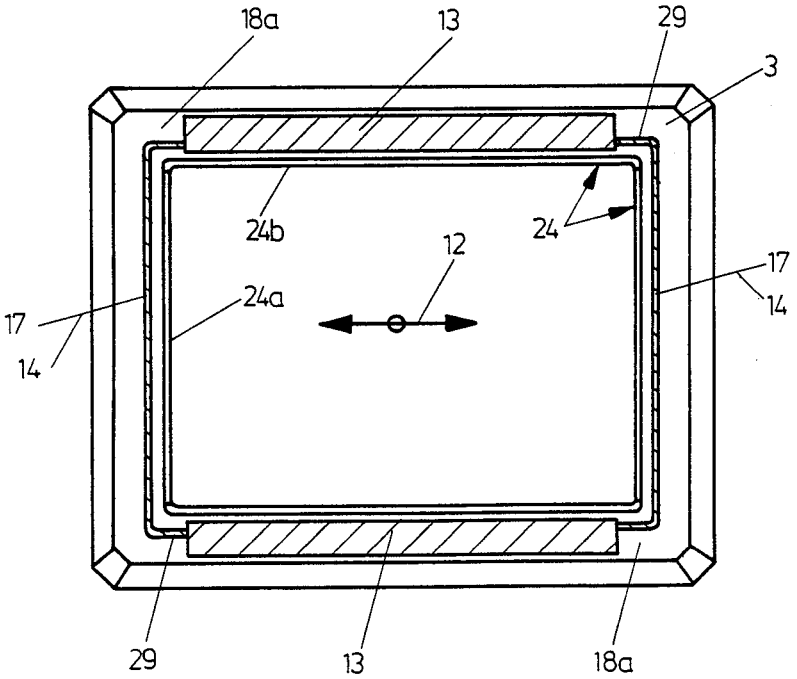
FIG. 5 is a top plan view in section taken along lies A—A of FIG. 1.

The apparatus of the present invention, illustrated in the drawings, comprises a filling unit 1 and a compression unit 2. A molding unit is coupled below compression unit 2 in a tightly sealed contacting manner to the compression unit outlet.

The molding unit is a composite of a frame 3 mounted on a molding box 4. Molding box 4 is supported on a pattern plate 6 which is in turn supported by a pattern plate carrier 5. A pattern 7 is supported on pattern plate 6 and is within and surrounded by molding box 4.

Rollers 8 are mounted on the sides of pattern plate carrier 5 and engage rails 9 permitting controlled movement of the molding unit in a predetermined direction from filling unit 1 to compression unit 2, and therefrom for further processing.

The top edge of molding frame 3 forms a sealing surface 18 on which sealing strips 13 and 14 depending from compression unit 2 engage. Sealing strips 13 extend parallel to the direction 12 of the molding unit movement, while sealing strips 14 extend perpendicularly relative to the direction of molding unit movement. The sealing strips are enclosed within a protective frame 11 and are releasably or detachably connected with a frame 15 to compression unit 2. To optimize use of the contacting surfaces forming the seal between the molding unit and compression unit, sealing strips 13 and 14 are individually adjustable.

The first pair of opposed sealing strips 13 are oriented such that they extend parallel to the direction 12 of molding unit movement, and are configured to absorb the impact pressure resulting from engagement of the molding unit with the compression unit. Recesses 16 extend lengthwise in the lower surface of sealing strips 13 to enhance their sealing effect.

Opposed sealing strips 14, contrary to sealing strips 13, are oriented such they extend transversely or perpendicularly to the direction 12 of molding unit movement. Each of the second pair of opposed sealing strips 14 have at least one sharp or cutting edge 17 projecting downwardly to contact the sealing surface on the molding unit. Sharp edge 17 provides sealing elements on sealing strips 14 which can engage the sealing surface without the use of great force to bring the sealing strip and sealing surface into sealing engagement.

Each of the second pair of opposed sealing strips 14 have opposed, substantially planar inner and outer sides 19 and 20, respectively, extending upwardly from sharp edge 17. The sides define an acute angle x therebetween. Inner side 19 is directed toward the inside of molding frame 3 and deviates angularly from the vertical or perpendicular. The lateral distance between frame inside 21 and the side 19 increases in the direction of compression unit 2 such that side 19 flares upwardly and outwardly. The outer side 20 forms an acute angle with sealing surface 18 such that it will exert a thrust or repelling force on molding material 22 lying on sealing surface 18.

By forming the sealing strips in this manner, any excess molding material lying on sealing surface 18 is forced from the sealing surface to provide a good seal between the compression unit and molding unit. Additionally, pressing of the molding material on the sealing surface is avoided which pressing action would adversely affect the molding unit-compression unit seal.

Sharp edges 17 of sealing strips 14 form a maximum contact distance 23 of about 2.0 mm in a direction parallel to direction 12 of molding unit movement. Preferably, the contact distance is about 0.7 mm. The contacting areas of sealing strips 13 and 14 with sealing surface 18 form an uninterrupted or continuous sealing line which is required for proper sealing of the molding unit to the compression unit.

On the interior of molding frame 3, adjacent sealing surface 18, a sheet metal frame 24 is detachably mounted. The mounting of the sheet metal frame within molding frame 3 permits the height of the sheet metal frame to be adjusted relative to sealing surface 18. For selective adjustment, sheet metal frame 24 has separate sections **24*a* perpendicular to the direction 12 of molding unit movement and separate sections 24*b* parallel to direction 12**. Each of these sections are separately coupled to the molding unit such that the height of each section can be separately set. The various sections of the sheet metal frame are coupled without spacing therebetween.

Sections **24*b* of sheet metal frame 24 extending parallel to the direction 12 of molding unit movement project vertically upwardly from sealing surface 18 for a substantial distance over sealing surface 18 and for a certain distance over the stripping level or plane 25 for flattening molding material 22. This extension of sections 24*b* prevents molding material from falling on sealing surface areas 18*a* extending parallel to the direction 12 of molding unit movement such that surface areas 18*a* transferring the pressure force between the molding unit and the compression unit are protected against overflow of the molding material. The transversely extending sections 24*a* of sheet metal frame 24 are adjusted to the stripping level 25 for the molding material 22 within the molding unit with a safety clearance being maintained between stripping level 25 and the top edge 26 of each transverse sheet metal frame section 24*a***.

For greater variances in stripping level 25, transverse sheet metal frame **24*a* can be lowered near sealing surface 18. Outer side 20 of sharp edge 17 will ensure that the molding material is moved from sealing surface 18** for providing a proper seal.

Sealing strips 14 with their cutting edges 17 are curved at right angles forming corner parts 29. The extension of the cutting areas slightly into the areas **18*a* of the sealing surface 18 extending parallel to the direction 12 of molding unit movement prevents molding material on the corners of the sealing surface 18** from adversely affecting the compression unit-molding unit seal. Additionally, these corner parts provide a continuous, uninterrupted sealing line extending about the entire periphery of the opening of the molding unit.

In operation, the molding unit is dosed with a predetermined amount of molding material, and is then moved beneath compression unit 2. During movement of the molding unit to a location below compression unit 2, a stripper 27 flattens or levels the molding material mass 22 to a predetermined level 25. Simultaneously, the sealing surface areas **18*a* extending parallel to direction 12 of molding unit movement can be simultaneously cleaned of molding material by brushes 28 or other suitable scraping devices. Once located beneath compression unit 2, the molding unit can be raised to sealing engagement with compression unit 2**. The molding material within the molding unit is then compressed in a conventional manner to produce a casting mold. For example, the molding materials can be compacted by a surge of pressure generated by a gaseous medium.

The apparatus of the present invention is advantageous since the molding unit filled with granular molding material can be tightly sealed to the compression unit without the molding unit sealing surface areas transverse to direction 12 being treated before the coupling in an additional processing step. Thus, the present apparatus expedites the compacting operation and eliminates an operational step provided in conventional apparatus without adversely affecting the compression unit-molding unit seal.

While various embodiments have been chosen to illustrate the invention, it will be understood by those skilled in the art the various changes and modifications can be made therein without departing from the scope of the invention as defined in the appended claims.

What is claimed is:

1. An apparatus for compacting granular molding materials, particularly foundry molding material, comprising:

a molding unit movable in a first direction;

filling means for supplying molding material into said molding unit;

compression means for compacting the molding material in said molding unit; and coupling means, at an outlet of said compression means, for forming a closed system between said compression means and said molding unit, said coupling means including a sealing surface and first and second pairs of opposed sealing strips engaging said sealing surface, said first pair of sealing strips extending substantially parallel to said first direction and having relatively broad and substantially planar contact surfaces oriented substantially parallel to said sealing surface for transmitting forces between said compression means and said molding unit when said contact surfaces engage said sealing surface, said second pair of sealing strips extending substantially perpendicular to said first direction and having relatively sharp, projecting edges formed by an apex of an angle between sides of each of said sealing strips of said second pair for contacting said sealing surface and repelling molding material from said sealing surface.

2. An apparatus according to claim 1 wherein said sealing strips are detachably connected to said compression means.

3. An apparatus according to claim 1 wherein said sealing strips are adjustable.

4. An apparatus according to claim 1 wherein said first pair of sealing strips form a continuous contact line on said sealing surface.

5. An apparatus according to claim 1 wherein said sharp edges contact said sealing surface for a contact distance not greater than about 2.0 mm in a direction parallel to said first direction.

6. An apparatus according to claim 5 wherein said contact distance is about 0.7 mm.

7. An apparatus according to claim 1 wherein each of said second pair of sealing strips has opposed substantially planar inner and outer sides extending from said sharp edge thereof and defining an acute angle therebetween.

8. An apparatus according to claim 7 wherein said outer sides repel said molding material.

9. An apparatus according to claim 1 wherein said sealing strips form a continuous sealing line on said sealing surface.

10. An apparatus according to claim 1 wherein said molding unit has an opening facing said compression means and a sheet metal frame extending about the periphery of said opening and toward said compression means.

11. An apparatus according to claim 10 wherein said sheet metal frame is adjustably coupled to said molding unit such that height thereof can be adjusted.

12. An apparatus according to claim 10 wherein a section of said sheet metal frame, extending parallel to said first direction, extends substantially beyond said sealing surface.

13. An apparatus according to claim 12 wherein said sheet metal frame has separate sections extending perpendicular to and parallel to said first direction, each of said sections being coupled to said molding unit such that each of said sections are separately adjustable in height.

14. An apparatus according to claim 1 wherein said sealing surface is part of said molding unit, and said sealing strips depend from said compression means.

15. An apparatus for compacting granular molding materials, particularly foundry molding material, comprising:

a molding unit movable in a first direction, said molding unit having an opening and a sheet metal frame extending about the periphery of said opening;

filling means for supplying molding material into said molding unit;

compression means for compacting the molding material in said molding unit, said opening facing said compression means, said sheet metal frame extending toward said compression means; and coupling means, at an outlet of said compression means, for forming a closed system between said compression means and said molding unit, said coupling means including a sealing surface and first and second pairs of opposed sealing strips engaging said sealing surface, and said first pair of sealing strips extending substantially parallel to said first direction and having force-transmitting sealing elements, said second pair of sealing strips extending substantially perpendicular to said first direction and having sealing elements which repel molding material from said sealing surface.

16. An apparatus according to claim 15 wherein said sheet metal frame is adjustably coupled to said molding unit such that height thereof can be adjusted.

17. An apparatus according to claim 15 wherein a section of said sheet metal frame, extending parallel to said first direction, extends substantially beyond said sealing surface.

18. An apparatus according to claim 17 wherein said sheet metal frame has separate sections extending perpendicular to and parallel to said first direction, each of said sections being coupled to said molding unit such that each of said sections are separately adjustable in height.

* * * * *